US007301430B1

(12) United States Patent
Chan et al.

(10) Patent No.: US 7,301,430 B1
(45) Date of Patent: Nov. 27, 2007

(54) HIGH VOLTAGE TRANSFORMER FOR CONTROLLING INDUCTANCE LEAKAGE

(75) Inventors: Chun-Kong Chan, Hsi Chih (TW); Jeng-Shong Wang, Hsin Chuang (TW); Jin-Jiun Jiang, Hsin Chuang (TW); Chi-Ming Yang, Hsin Chuang (TW)

(73) Assignee: Lien Chang Electronic Enterprise Co., Ltd., Taipei County (TW)

( * ) Notice: Subject to any disclaimer, the term of this patent is extended or adjusted under 35 U.S.C. 154(b) by 92 days.

(21) Appl. No.: 11/434,159

(22) Filed: May 16, 2006

(51) Int. Cl.
*H01F 5/00* (2006.01)

(52) U.S. Cl. ..... 336/200; 336/212

(58) Field of Classification Search ..... 336/65, 336/83, 178, 192, 198, 212–214, 223
See application file for complete search history.

(56) References Cited

U.S. PATENT DOCUMENTS 6,483,411 B2 * 11/2002 Chiang et al. ..... 336/182
6,714,111 B2 * 3/2004 Suzuki ..... 336/110
6,894,596 B2 * 5/2005 Suzuki ..... 336/83
7,015,785 B2 * 3/2006 Wu et al. ..... 336/212
7,183,889 B2 * 2/2007 Fushimi ..... 336/208

* cited by examiner

*Primary Examiner*—Tuyen T. Nguyen
(74) *Attorney, Agent, or Firm*—Rosenberg, Klein & Lee

(57) ABSTRACT

A high voltage transformer for controlling inductance leakage used for a multiple lamp driving system includes at least one wire frame, a first winding, a second winding, a first magnetic unit, and a second magnetic unit. There is a receiving space in the wire frame for receiving the first magnetic unit, and a first region and a second region is formed on its surface. The first winding and the second winding are individually wound at the first region and the second region. The second magnetic unit is covered on the side of the wire frame. On an appropriate location of the bottom of the second magnetic unit, a transverse beam extends. Thereby, the transverse beam fully separates the low voltage magnetic flux path produced on the first magnetic unit by the first winding and the second winding and the high voltage magnetic flux path produced by the AC.

21 Claims, 5 Drawing Sheets

HIGH VOLTAGE TRANSFORMER FOR CONTROLLING INDUCTANCE LEAKAGE

BACKGROUND OF THE INVENTION

1. Field of the Invention

The present invention relates to a high voltage transformer for controlling inductance leakage. In particular, this invention changes the shape of the magnetic unit located at the outside of the wire frame to control loss due to the transformer being switched between high voltage and low voltage. Thereby, the magnetic flux is lowered, the inductance leakage of the transformer is controlled and the dimensions of the transformer are acceptable.

2. Description of the Related Art

LCD monitors and LCD TVs are commonly owned apparatuses today. They are also applied in industry, such as tools for monitoring, operating, and advertising. LCD monitors and LVD TVs use a multiple lamp driving system that is composed of CCFLs and driving transformers as a backlight. Therefore, the endurance and the stability of the transformer are the key factors of the product yield rate.

FIG. 1 shows a transformer of the prior art. The transformer has a wire frame a. There is a receiving space a1 in the wire frame a for receiving a first magnetic unit b. The surface of the wire frame a is separated into a first region a2 and a second region a3. A first winding c and a second winding d are individually wound at the first region a2 and the second region a3 of the wire frame a. An inverted U-shaped second magnetic unit e is covered on the side of the wire frame a.

The described transformer has the drawbacks:

1. The magnetic flux of the transformer is too high. Therefore, switching loss caused by switching the transformer between high voltage and low voltage cannot be controlled well. The switching loss caused by switching the transformer between high voltage and low voltage lowers the efficiency of the magnetic unit so that the transformer has an overheating problem. In order to exhaust the heat, the dimension of the transformer becomes larger so that the transformer occupies a larger space.

2. The magnetic unit of the prior transformer cannot control the inductance leakage. So, it does not fit in with the requirements of LCD monitors or LCD TVs.

3. In order to achieve a good visual effect for LCD monitors or LCD TVs, the number of the lamps is increased. The prior transformer cannot drive a plurality of lamps via a high voltage transformer.

SUMMARY OF THE INVENTION

One particular aspect of the present invention is to provide a high voltage transformer for controlling inductance leakage. This invention changes the shape of the magnetic unit located at the outside of the wire frame to control loss due to the transformer being switched between high voltage and low voltage. Thereby, inductance leakage of the transformer is controlled and the dimension of the transformer is acceptable.

The high voltage transformer for controlling inductance leakage includes at least one wire frame, and there is a receiving space in the wire frame. The surface of the wire frame forms at least one first region and one second region. A first winding is wound at the first region of the wire frame. A second winding is wound at the second region of the wire frame. At least one first magnetic unit is installed in the receiving space of the wire frame. A second magnetic unit is covered on the side of the wire frame. On an appropriate location of the bottom of the second magnetic unit, a transverse beam extends and is used for separating the first region and the second region.

The transverse beam of the second magnetic unit fully separates the low voltage magnetic flux path produced on the first magnetic unit by the first winding and the second winding and the high voltage magnetic flux path produced by the AC. The switch loss between the high voltage and the low voltage is controlled, and the inductance leakage of the transformer is enhanced.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
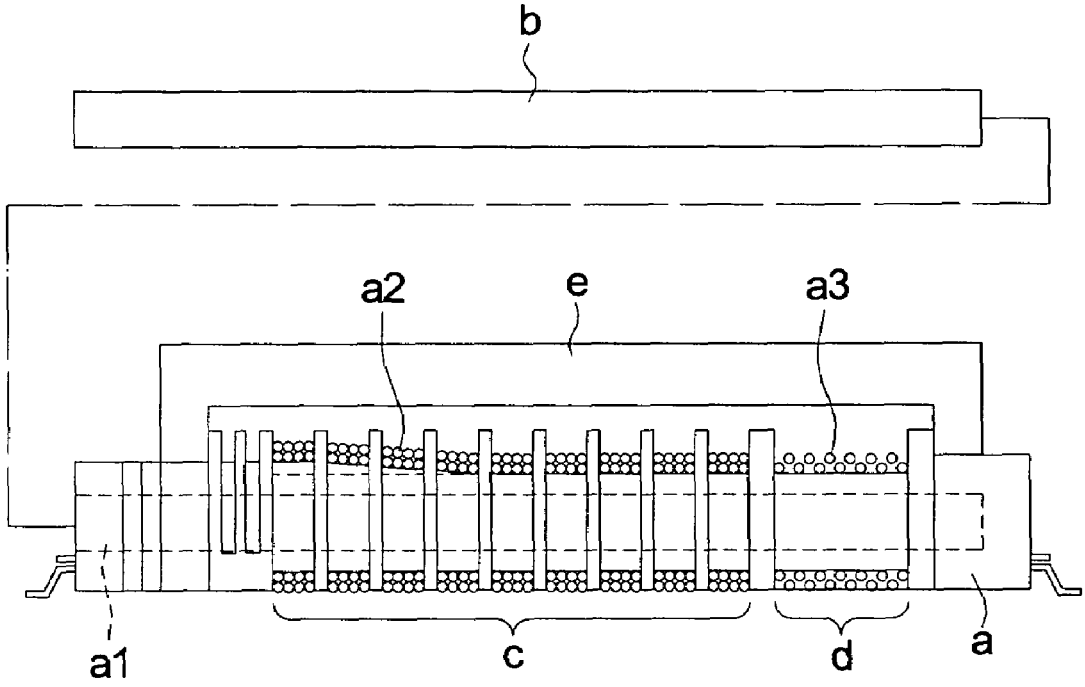
FIG 1 PRIOR ART
FIG. 1 is a schematic diagram of the transformer of the prior art.
Figure 2:
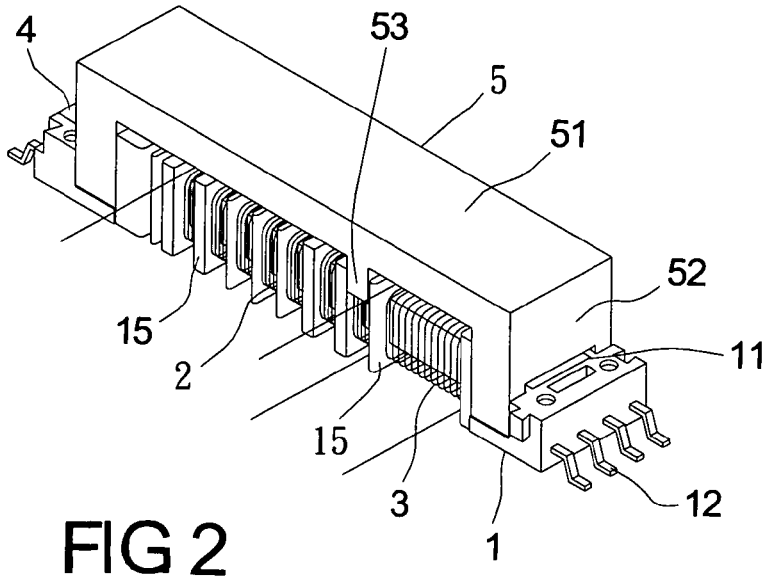
FIG. 2 is a perspective view of the transformer of the present invention.
Figure 3:
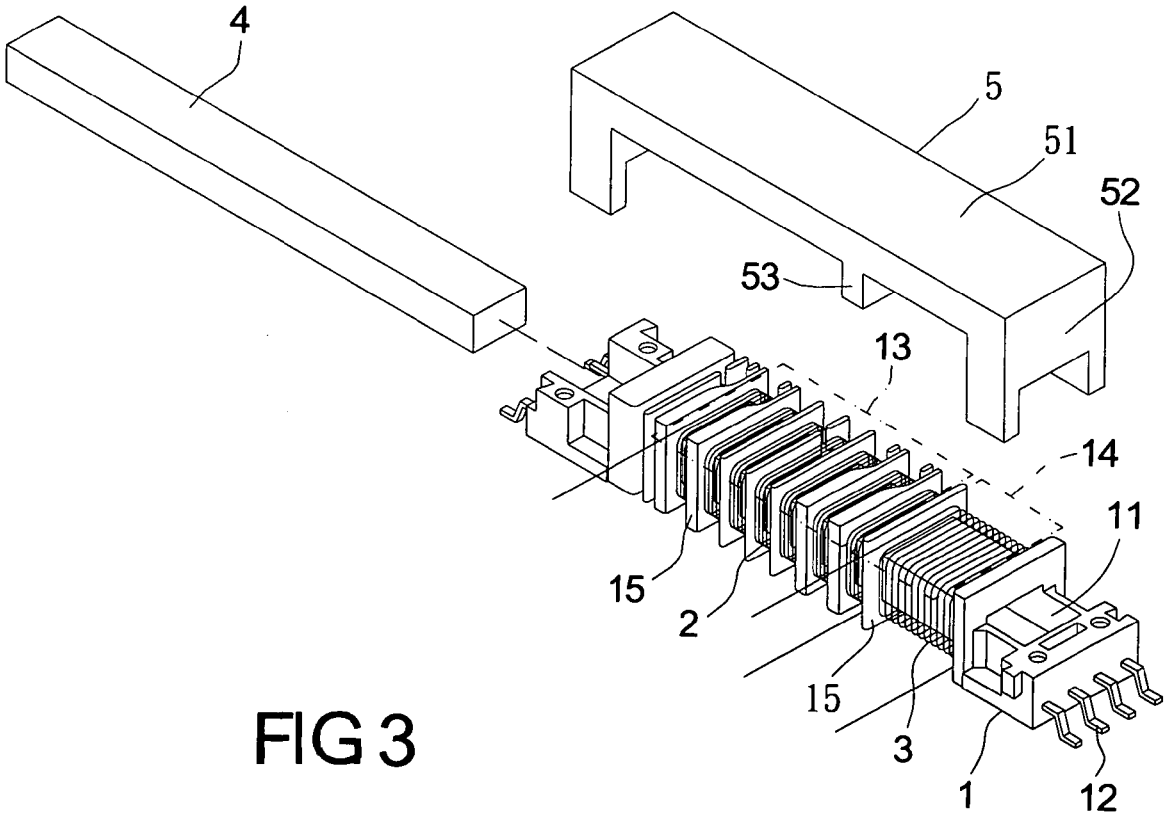
FIG. 3 is an exploded perspective view of the transformer of the present invention.
Figure 4:
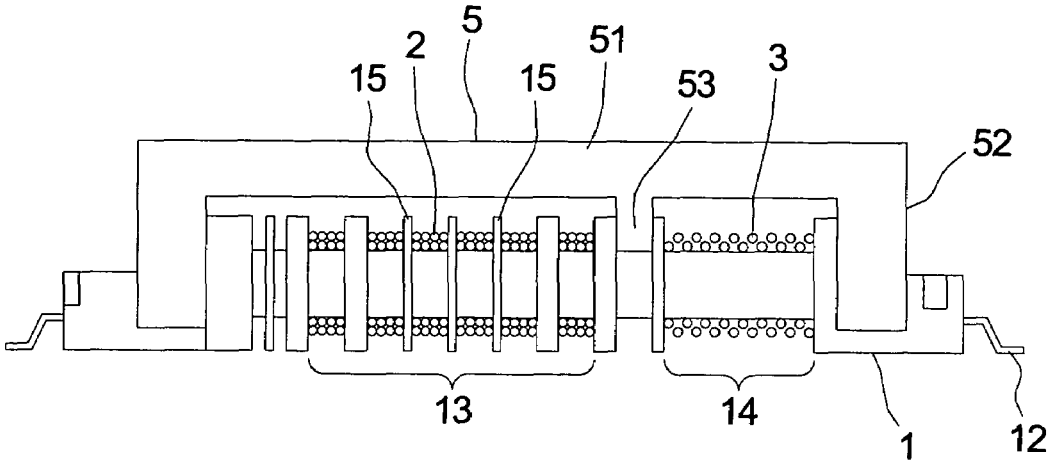
FIG. 4 is a side view of the transformer of the present invention.

Reference is made to FIGS. 2, 3 and 4. The high voltage transformer for controlling inductance leakage includes a wire frame 1, a first winding 2, a second winding 3, a first magnetic unit 4, and a second magnetic unit 5.

The wire frame has a through-tube shaped body. There is a receiving space 11 in the wire frame 1. At the two ends of the wire frame 1, a plurality of electric pins 12 are extended. One end is individually conducted with the first winding 2 and the second winding 3. The surface of the wire frame 1 forms at least one first region 13 and one second region 14. There are a plurality of blocking walls disposed at a distance from each other on the surface of the wire frame 1 along the first region 13 and the second region 14.

The first winding 2 is wound upon a slot-shaped space formed by the blocking walls 15 located at the first region 13 so as to form a primary side winding region.

The second winding 3 is wound at a slot-shaped space formed by the blocking walls 15 located at the second region 14 so as to form a secondary side winding region.

The first magnetic unit 4 has a column shape and is plugged into the receiving space 11 from one end of the wire frame 1.

The second magnetic unit 5 is a flat sheltering body. The second magnetic unit 5 has a board body 51. The board body 51 is covered on the top side of the wire frame 1 and installed on the blocking walls 15. At both the front and back end of the board body 51, there is a side board 52 extending downward. The side boards shelter the first region 13 and the second region 14 located on the surface of the wire frame 1. At an appropriate location of the bottom of the board body 51, a transverse beam 53 extends downward. The transverse beam 53 is adjacent to a specified blocking wall 15. Alternatively, the transverse beam 53 is plugged into the slot-shaped space formed by two adjacent blocking walls 15 or two specified blocking walls 15. The transverse beam 53 is used for separating the first region 13 and the second region 14. The transverse beam 53 of the second magnetic unit 5 securely fits with two specified adjacent blocking walls 15 so as to provide a holding function.

Figure 5:
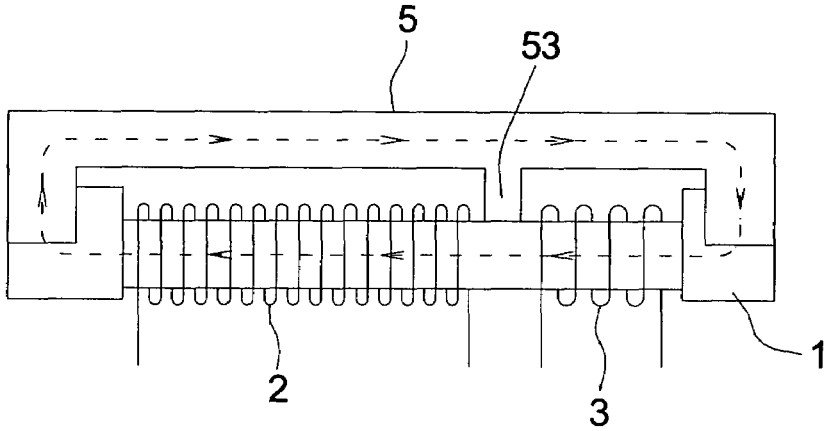
FIG. 5 is a schematic diagram of the magnetic force line of the present invention.

When the high voltage transformer for controlling inductance leakage is implemented in a multiple lamp driving system, as shown in FIGS. 3, 4 and 5, the transverse beam 53 of the second magnetic unit 5 is located between the first winding 2 (a low voltage coil) on the first region 13 and the second winding 3 (a high voltage coil) on the second region 14. When a voltage is inputted into the first winding 2, one end of the first magnetic unit 4 is located in the low voltage coil and another end of the first magnetic unit 4 is located in the high voltage coil. There is a gap between both. When the first winding 2 is conducted, the second winding 3 generates an induced electromotive force to make the magnetic unit 4 and the magnetic unit 5 located at the low voltage coil form a magnetic force line. The magnetic unit 4 and the magnetic unit 5 located at the high voltage coil form another magnetic force line. The first winding 2 and the second winding 3 individually form an independent magnetic force line on a magnetic unit set. The transverse beam 53 fully separates the low voltage magnetic flux path from the high voltage magnetic flux path produced by the AC. The inductance leakage is well controlled to increase energy storage and efficiency, and it is insured that the magnetic force line travels along the magnetic path so as to light up the lamps.

Figure 6:
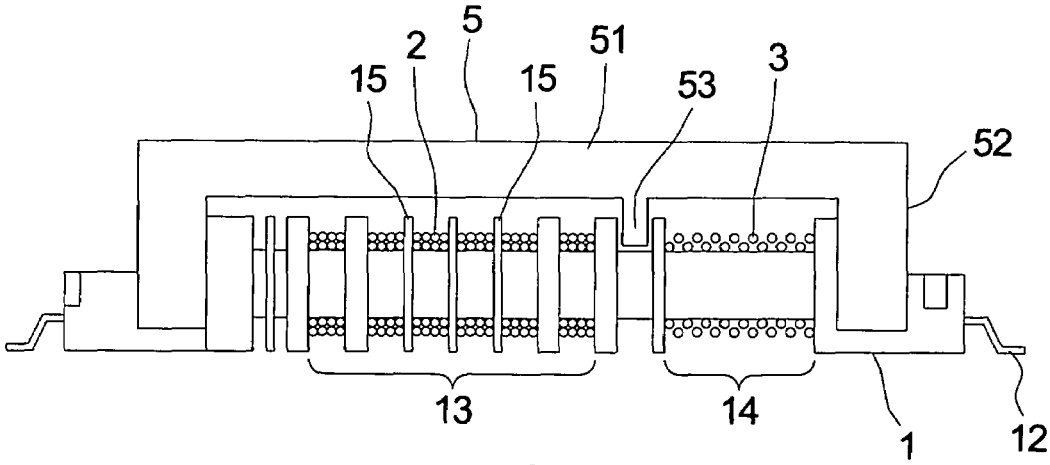
FIG. 6 is a perspective view of the second embodiment of the transformer of the present invention.

FIG. 6 shows a perspective view of the second embodiment of the transformer of the present invention. The distance of the slot-shaped space on the wire frame formed by two specified adjacent blocking walls 15 is greater than the transverse beam 53. Therefore, the transverse beam 53 can be moved in the slot-shaped space.

Figure 7:
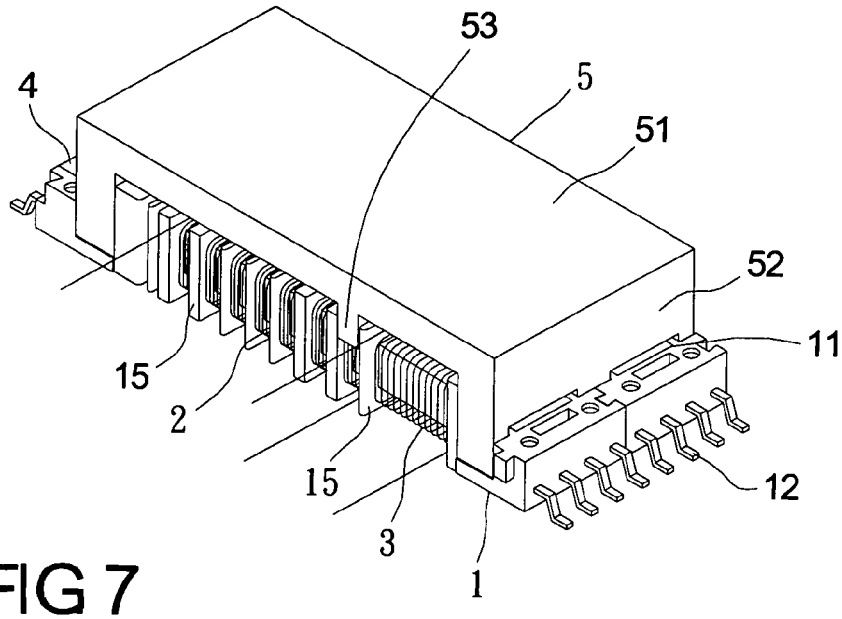
FIG. 7 is a perspective view of the third embodiment of the transformer of the present invention.
Figure 8:
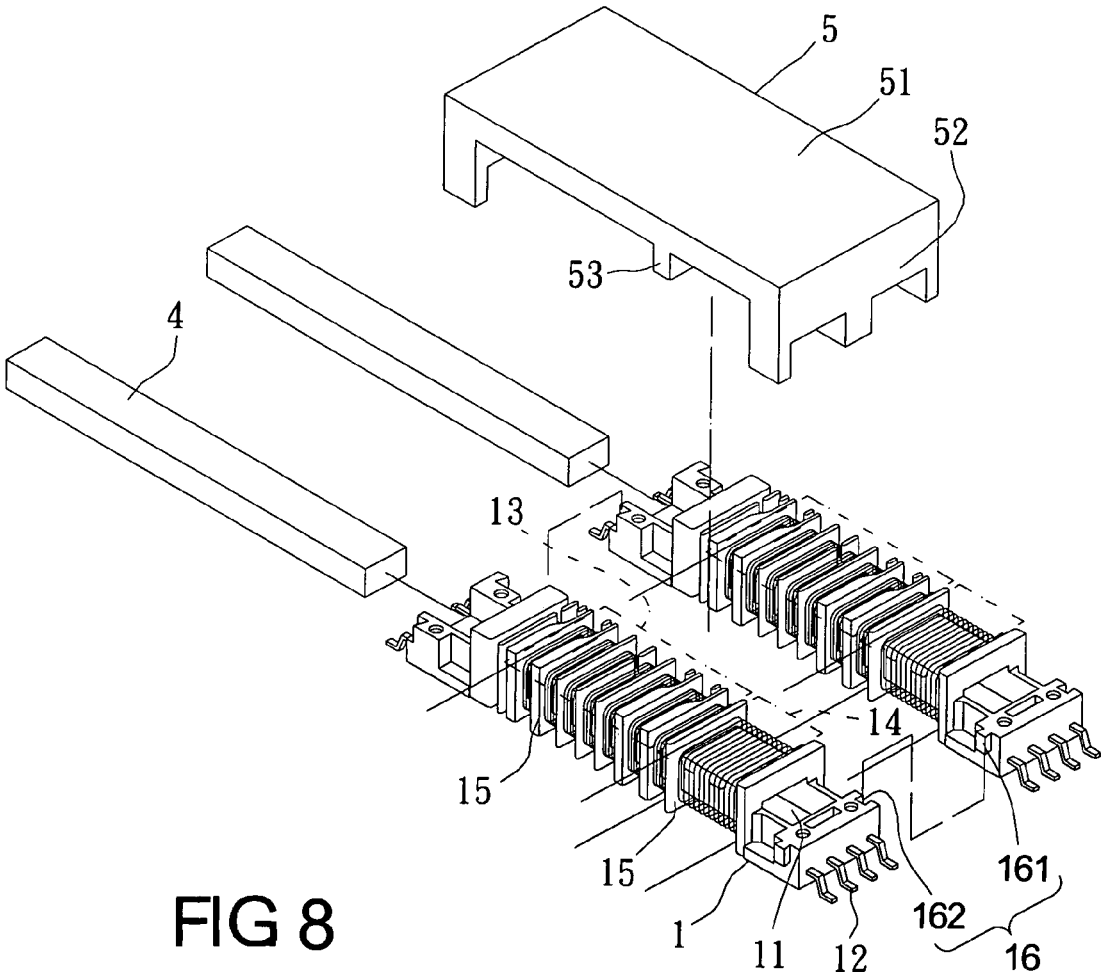
FIG. 8 is an exploded perspective view of the third embodiment of the transformer of the present invention.

Reference is made to FIGS. 7 and 8, which show a perspective view of the third embodiment of the transformer of the present invention. The high voltage transformer for controlling inductance leakage includes two wire frames 1, two first windings 2, two second windings 3, two first magnetic units 4, and a second magnetic unit 5. Two linking element sets 16 are located at the side of the wire frame 1. The linking element set 16 is composed of at least one tenon 161 located at one side of the wire frame 1 and a concave slot 162 located at another side of the wire frame 1. By assembling the tenon 161 and the concave slot 162 located on the two sides of the one wire frame 1 with the tenon 161 and the concave slot 162 of another adjacent wire frame 1, the two wire frames 1 are assembled with each other and there is an appropriate gap between the two wire frames 1.

Each of the first windings 2 is wound at a slot-shaped space formed by the blocking walls 15 located at the first region 13 on the corresponding wire frame 1 so as to form a primary side winding region.

Each of the second windings 3 is wound at a slot-shaped space formed by the blocking walls 15 located at the second region 14 on the corresponding wire frame 1 so as to form a secondary side winding region.

The two first magnetic units 4 are plugged into the receiving space 11 from one end of the wire frame 1.

The second magnetic unit 5 is a flat sheltering body. The second magnetic unit 5 has a board body 51. The board body 51 covers the top side of the two wire frames 1 and is installed on the blocking walls 15 located on the surface of the two wire frames 1. At the front and back end of the board body 51, there is a side board 52 extending downward. The two side boards are wedged at the outside of the first region 13 and the second region 14 located on the surface of the wire frame 1. On an appropriate location of the bottom of the board body 51, a transverse beam 53 extends downward. The transverse beam 53 is adjacent to a specified blocking wall 15. Alternatively, the transverse beam 53 is plugged into the slot-shaped space formed by two adjacent blocking walls 15 or two specified blocking walls 15. The transverse beam 53 is used to separate the first region 13 and the second region 14.

When the high voltage transformer for controlling inductance leakage is implemented in a multiple lamp driving system, as shown in FIGS. 7 and 8, the number of wire frames 1 is increased so as to increase the amount of outputted high voltage. Therefore, the transformer can be expanded according to the number of lamps of the multiple lamp driving system. The transverse beam 53 fully separates the low voltage magnetic flux path from the high voltage magnetic flux path produced by the AC to control the inductance leakage well. The driving unit formed by the two first windings 2 is a full-bridge, a half-bridge, a push-pull, or a royer type.

Figure 9:
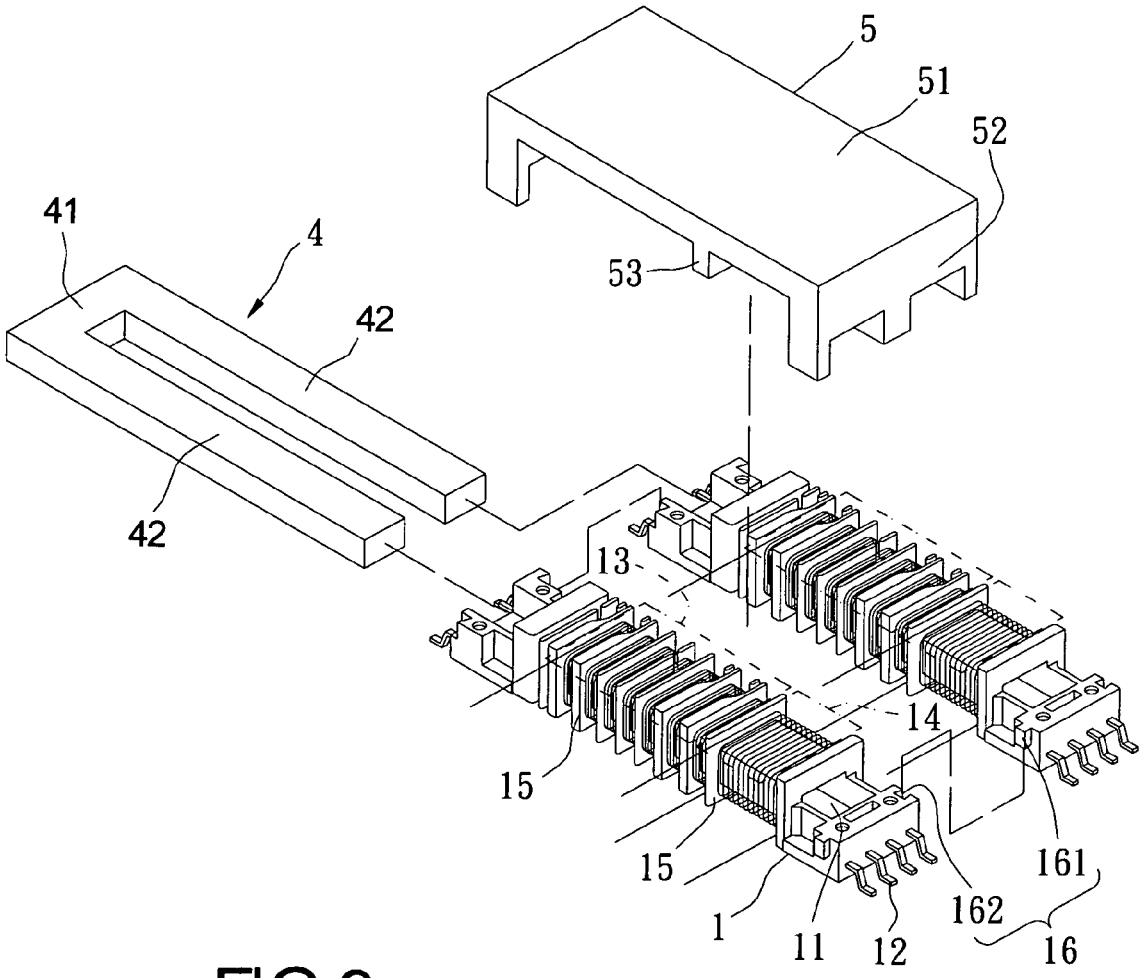
FIG. 9 is an exploded perspective view of the fourth embodiment of the transformer of the present invention.

FIG. 9 shows a perspective view of the fourth embodiment of the transformer of the present invention. Each of the two first magnetic units 4 is plugged into the receiving space 11 of the wire frame 1 from one end of the corresponding wire frame 1. The first magnetic unit 4 is a beam body 41. A plurality of plugging rods extends from one side of the beam body 41. Each of the plugging rods is plugged into the receiving space 11 of each wire frame 1. Changing the shape of the first magnetic unit 4 makes the primary side winding region formed by the two first windings 2 separate from the secondary side winding region formed by the two second windings 3 so as to form the magnetic flux path.

The present invention has the following characteristics:

1. The present invention separates the primary side winding region from the secondary side winding region via the transverse beam 53 of the magnetic unit located on the outside of the wire frame 1 so as to control the switching loss caused by switching between high voltage and low voltage, and reduce the magnetic flux.

2. The present invention reduces the switching loss so as to prevent the transformer from overheating. The usage life of the transformer is extended and the usage cost is reduced.

3. The present invention can control the inductance leakage to fit in with the requirements of LCD monitors or LCD TVs.

4. The present invention increases the number of wire frames 1 according to the number of the lamps of the multiple lamp driving system. The amount of outputted high voltage is expanded to fit in with the requirements of the user.

5. The plurality of wire frames 1 of the present invention can be connected and fastened via the linking element 16. The structure of the wire frame set is enhanced to prevent the wire frame set from being damaged, such as by separating from each other or being located in the wrong location, etc.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A high voltage transformer for controlling inductance leakage, used for a multiple lamp driving system, comprising:

at least one wire frame, wherein there is a receiving space in the wire frame and the surface of the wire frame forms at least one first region and one second region;

a first winding wound at the first region of the wire frame;

a second winding wound at the second region of the wire frame;

at least one first magnetic unit installed in the receiving space of the wire frame;

a second magnetic unit covering the side of the wire frame, wherein at an appropriate location of the bottom of the second magnetic unit, a transverse beam extends and is used for separating the first region and the second region;

thereby, the transverse beam of the second magnetic unit fully separates the low voltage magnetic flux path produced on the first magnetic unit by the first winding and the second winding and the high voltage magnetic flux path produced by the AC.

2. The high voltage transformer for controlling inductance leakage as claimed in claim 1, wherein the wire frame is a through-tube shaped body, there is a receiving space in the wire frame, and, a plurality of electric pins extend from the two ends of the wire frame.

3. The high voltage transformer for controlling inductance leakage as claimed in claim 1, wherein the first magnetic unit has a column shape.

4. The high voltage transformer for controlling inductance leakage as claimed in claim 1, wherein there are a plurality of regions along the surface of the wire frame, and a plurality of blocking walls are disposed at a distance from each other.

5. The high voltage transformer for controlling inductance leakage as claimed in claim 1, wherein a plurality of blocking walls are disposed at a distance from each other between the first region and the second region on the surface of the wire frame.

6. The high voltage transformer for controlling inductance leakage as claimed in claim 5, wherein the second magnetic unit is installed on the blocking walls, and the transverse beam is located at the adjacent side of a specified blocking wall to separate the first region and the second region.

7. The high voltage transformer for controlling inductance leakage as claimed in claim 5, wherein the second magnetic unit is installed on the blocking walls, and the transverse beam is plugged into a slot-shaped space formed by two adjacent blocking walls to separate the first region and the second region.

8. The high voltage transformer for controlling inductance leakage as claimed in claim 5, wherein the transverse beam of the second magnetic unit is plugged into a slot-shaped space formed by two specified adjacent blocking walls to separate the first region and the second region.

9. The high voltage transformer for controlling inductance leakage as claimed in claim 8, wherein the transverse beam of the second magnetic unit is securely fitted with the two specified adjacent blocking walls.

10. The high voltage transformer for controlling inductance leakage as claimed in claim 8, wherein the distance of the slot-shaped space formed by two specified adjacent blocking walls is greater than the transverse beam so that the transverse beam is movable in the slot-shaped space.

11. The high voltage transformer for controlling inductance leakage as claimed in claim 1, wherein the second magnetic unit is a flat sheltering body.

12. The high voltage transformer for controlling inductance leakage as claimed in claim 11, wherein the second magnetic unit is a board body, at the front and back end of the board body, each has a side board extending downward, and the traverse beam extends downward from an appropriate location of the bottom of the board body.

13. The high voltage transformer for controlling inductance leakage as claimed in claim 12, wherein the side boards are individually wedged at the outside of the first region and the second region of the wire frame.

14. The high voltage transformer for controlling inductance leakage as claimed in claim 5, wherein the first winding is wound at a slot-shaped space formed by the blocking walls located at the first region so as to form a primary side winding region.

15. The high voltage transformer for controlling inductance leakage as claimed in claim 5, wherein the second winding is wound at a slot-shaped space formed by the blocking walls located at the second region so as to form a secondary side winding region.

16. The high voltage transformer for controlling inductance leakage as claimed in claim 1, comprising:

at least two wire frames located adjacent to each other, wherein there is a receiving space in the wire frame and the surface of the wire frame forms at least one first region and one second region;

at least two first windings individually wound at the first region of the corresponding wire frame;

at least two second windings individually wound at the second region of the corresponding wire frame;

at least one first magnetic unit installed in the receiving space of the wire frame;

a second magnetic unit crossed on the side of the wire frames, wherein on an appropriate location of the bottom of the second magnetic unit, a transverse beam extends and is used for separating the first region and the second region;

thereby, the transverse beam of the second magnetic unit fully separates the low voltage magnetic flux path produced on the first magnetic unit by the first winding and the second winding and the high voltage magnetic flux path produced by the AC.

17. The high voltage transformer for controlling inductance leakage as claimed in claim 16, wherein at least one linking element set is located at the side of the wire frame, one wire frame is assembled with another wire frame via the linking element located at the side of the wire frame and corresponds to the linking element of an adjacent wire frame.

18. The high voltage transformer for controlling inductance leakage as claimed in claim 17, wherein two linking element sets are located at the side of the wire frame.

19. The high voltage transformer for controlling inductance leakage as claimed in claim 18, wherein the linking element set is composed of at least one tenon located at one side of the wire frame and a concave slot located at another side of the wire frame, and, by assembling the tenon and the concave slot located at the two sides of the one wire frame with the tenon and the concave slot of another adjacent wire frame, the two wire frames are assembled with each other.

20. The high voltage transformer for controlling inductance leakage as claimed in claim 16, wherein the first magnetic unit has a beam body, a plurality of plugging rods extends from one side of the beam body, and each of the plugging rods is plugged into the receiving space of each wire frame.

21. The high voltage transformer for controlling inductance leakage as claimed in claim 20, wherein the two first magnetic units are individually plugged into the receiving space of the each wire frame from one side of the corresponding wire frame.

* * * * *